United States Patent [19]

Lang

[11] 4,238,904

[45] Dec. 16, 1980

[54] TOY DISPLAYING ERRATIC TUMBLING MOVEMENT

[76] Inventor: Dorothy M. Lang, 181 Dunk Rock Rd., Guilford, Conn. 06437

[21] Appl. No.: 44,843

[22] Filed: Jun. 4, 1979

[51] Int. Cl.[3] ..... A63H 33/00

[52] U.S. Cl. ..... 46/1 R; 46/134; 273/128 A

[58] Field of Search ..... 46/134, 43, 1 R; 273/108, 120 R, 128 R, 128 A

[56] References Cited

U.S. PATENT DOCUMENTS

| | | | |
|---|---|---|---|
| 1,254,428 | 1/1918 | Myers | 46/134 |
| 1,494,963 | 5/1924 | Smith | 46/1 R |
| 3,192,663 | 7/1965 | Kirschner | 273/128 A X |
| 3,400,932 | 9/1968 | Conrad | 273/128 A X |

*Primary Examiner*—Robert Peshock

*Assistant Examiner*—Mickey Yu

*Attorney, Agent, or Firm*—William W. Jones

[57] ABSTRACT

The toy is made with a hollow housing having a generally polygonal configuration in plan view, and having arcuate side walls which form pivoting axes about which the toy can tumble when positioned on an inclined planar surface, a stairway, or the like. The toy has at least two major planar sides whereby progressive tumbling movement of the toy occurs from one major planar side to another about ones of the arcuate side walls when the toy is positioned on an inclined planar surface. A sphere, or the like, is provided freely movable within the confines of the housing to impart momentum to the housing whereby the tumbling of the toy results. The tumbling movement is erratic due to the included angle between potential pivoting axes, and due to the intervening major planar surfaces on which the toy momentarily stops during tumbling.

3 Claims, 4 Drawing Figures

TOY DISPLAYING ERRATIC TUMBLING MOVEMENT

This invention relates to a toy which has an erratic tumbling movement when positioned on an inclined planar surface, a stairway or the like.

Toys of the type which produce stepwise movements when positioned on inclined surfaces or on a stairway are known generally in the art. Examples of such toys include the flexible metal spiral coil toy sold under the brand name "Slinky" by James Industries, the artificial Mexican jumping bean made from a plastic elongated capsule containing a movable BB pellet therein, and a somewhat similar toy which can be made from construction paper and a ball, the latter toy being illustrated in a set of activity cards produced by Nu Products A. G. and copyright in 1970.

The motion produced by the above-enumerated toys can be generally described as a step-wise, end-over-end progession which advances the toy downwardly across an inclined surface or stairway on which the toy is positioned. This form of toy has proven amusing to small children; however, the form of movement which this type of toy displays is somewhat limited so that the toy cannot be readily adapted for diverse uses, as, for example, a game piece, or the like. For example, if the Mexican jumping bean-type toy should become disoriented during movement, it will merely roll down the surface on which it is positioned about its axis of elongation, thereby losing the step-wise mode of movement for which it is designed.

I have invented an improved step-wise movement-type toy which displays erratic movement with respect to direction as it descends, and which cannot become disoriented during descent so as to fail to continue its intended step-wise erratic tumbling movement. Further, the action of this toy is such that it is multi-directional in function, thereby having the directional flexibility of a ball (sphere), but with a slower stepwise tumbling type of movement. This characteristic enables the toy to be manipulated by a skilled person on a freely inclinable planar surface, at a rate more within human physical limits than would be possible with any sphere.

In its preferred embodiment, my improved toy comprises a hollow housing having a generally triangular shape when seen in a plan view. The triangular configuration is preferable equi-lateral. The housing includes upper and lower major planar surfaces and convexly curved arcuate side surfaces which interconnect the sides of the major planar surfaces. The three corners of the housing where the side surfaces would meet are preferably left open to the interior of the housing. A sphere of appropriate size and weight is disposed within the housing and freely movable therein to impart momentum to the toy as the latter progressively moves down the surface on which it is positioned.

It is, therefore, an object of this invention to provide an improved toy which will display erratic, multi-directional, step-wise tumbling movement when placed on an inclined surface, or the like.

It is a further object of this invention to provide an improved toy of the character described having a hollow housing of generally polygonal configuration, and having convex side surfaces interconnecting major planar surfaces.

It is yet another object of this invention to provide an improved toy of the character described having a spherical body disposed in the interior of the housing and freely movable therein to impart momentum and direction to the toy as it moves over the surface on which it is positioned.

These and other objects and advantages of the invention will be more readily understood and appreciated from the following detailed description of a preferred embodiment of the invention taken in conjunction with the accompanying drawings, in which.

Figure 1:
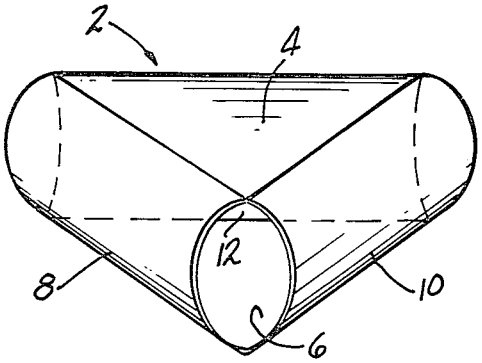
FIG. 1 is a perspective view of a preferred embodiment of the toy of this invention as seen looking at one apex, the form of the toy being generally triangular.
Figure 2:
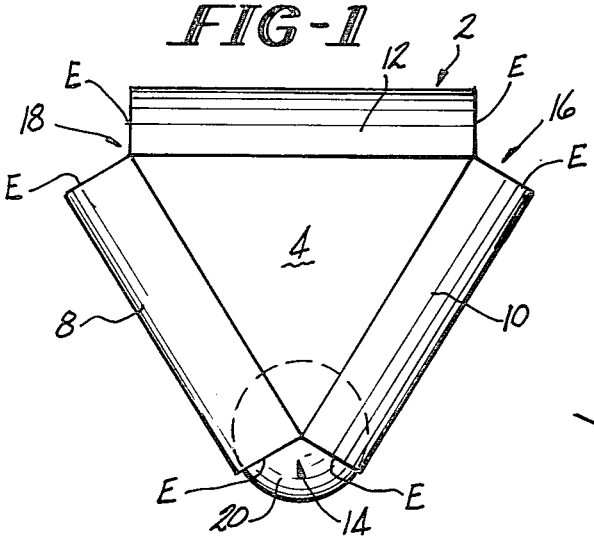
FIG. 2 is a top plan view of the toy of FIG. 1 showing its general triangular configuration and showing the momentum-imparting sphere protruding from one corner of the housing part of the toy.

Referring now to the drawings, there is shown in FIG. 1 a preferred embodiment of a toy formed in accordance with this invention. In its preferred form, the toy includes a housing denoted generally by the numeral 2, which housing preferably has a generally triangular configuration. The housing 2 is hollow and includes opposed major, generally planar surfaces 4 and 6 which are generally triangular in configuration and generally parallel to each other. Interconnecting the sides of the major surfaces 4 and 6 are convexly arcuate side walls 8, 10 and 12. The three corners of the housing 2 are preferably left open so as to communicate with the interior of the housing 2 at 14, 16 and 18 (see FIG. 2). Inside of the housing 2, there is disposed a momentum-producing means preferably in the form of a spherical body 20, as shown in FIG. 2. The spherical body 20 is sized so as to be freely movable within the interior of the housing 2. It will be noted that the space between the opposed edges E of the side walls 8, 10 and 12 is sized so as to prevent the spherical body 20 from exiting from the housing interior. Preferably, as shown in FIG. 2, the spherical body 20 can protrude through the open corners 14, 16 or 18 of the housing sufficiently to provide a relatively smooth curved surface or radius between adjacent side walls 8, 10 and 12, and between corresponding corners of the major planar surfaces 4 and 6.

Figure 3:
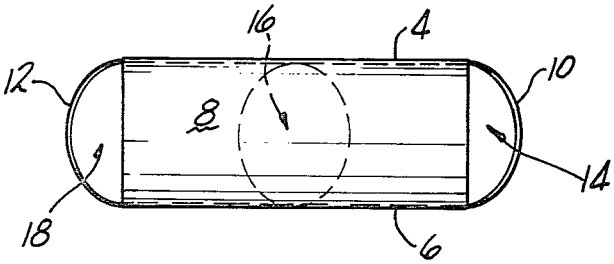
FIG. 3 is a side elevational view of the toy of FIG. 1 as seen viewing one side wall of the housing part of the toy.

Referring now to FIG. 3, there is shown a side elevational view as seen looking directly at one of the side walls 8, 10, or 12, in this view, the side wall 8 being shown directly on. The curvature of the side walls 8, 10 and 12 is shown, as well as the shape of the opening 12, 16 and 18. The major planar surfaces 4 and 6 are also shown.

Figure 4:
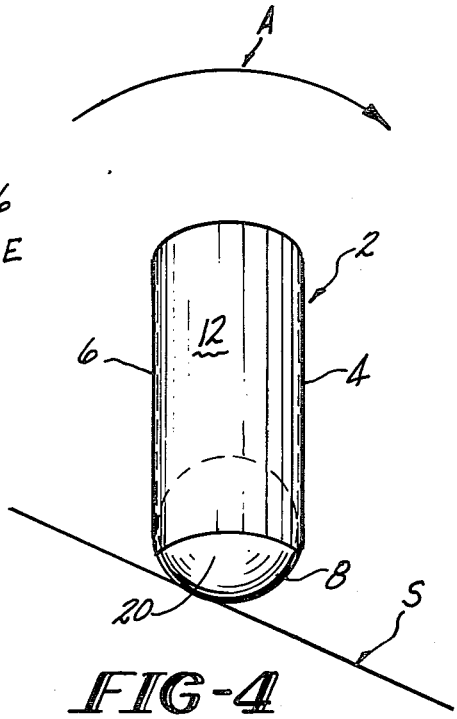
FIG. 4 is a side view of the toy of FIG. 1 shown on an inclined surface as it tumbles over one of the convex side surfaces of the housing of the toy.

In FIG. 4, the toy is shown as it tumbles down an inclined surface S. As shown in FIG. 4, the toy is tumbling in a clockwise direction, or in the direction of the arrow A. The toy is depicted as it pivots about one of its curvilinear side walls 8. The spherical body 20 is shown at the lower region of the housing 2 adjacent to the side wall 8.

The nature of the tumbling motion which the toy of this invention displays can be described as follows. The toy is placed on an inclined surface on one of its major planar surfaces 4 and 6 and released. The spherical body 20 moves to the lowest part of the interior of the housing 2, whereupon the spherical body 20 is stopped by contact with one or more of the side walls of the housing, contact with two of the side walls occurring if the spherical body moves into one of the open corners of the housing. The momentum of the spherical body then causes the housing to pivot about one of its lowermost curvilinear side walls whereby the housing flips over and the other of the major planar surfaces is brought into contact with the inclined surface on which the toy rests. The housing momentarily stops movement along the inclined surface until the spherical body can move inside of the housing again to the lowest part thereof whereupon the housing again flips over onto the first major planar surface. This mode of movement continues until the toy reaches the bottom of the inclined surface over which it is moving. Thus, the mode of movement of the toy is an alternating sequence of pause, tumble, pause, tumble, and so on. The exact direction in which the toy pivots as it tumbles is somewhat erratic from one pivot to the next because the housing will usually pivot about the first curved side wall which the spherical body contacts as it moves to the lowest region of the housing interior. Also, the housing can pivot about one of its corners in the event that the spherical body moves directly into such corner. In the latter case, the protruding part of the spherical body provides the curved surface about which the housing pivots.

While the preferred configuration of the toy of this invention is triangular, it will be appreciated that other polygonal configurations could be made without departing from the spirit of this invention. Also, the major planar surfaces of the toy need not be parallel to each other, for example, the housing could be made in a generally pyramid shape. The housing of the toy can be made from a variety of materials such as heavy paper, various plastics, or the like. Plastics would be preferred, however, for durability. If desired, the outer surfaces of the housing can be made with a relatively high coefficient of friction so as to ensure that the toy tumbles rather than slides during use. To this end, the outer surfaces of the housing can be roughened, or can be formed from an inherently high coefficient of friction material.

It will be readily appreciated that the toy of this invention will be intrinsically amusing for children and could also form the basis for game pieces, or the like.

Since many changes and variations of the disclosed embodiment of the invention may be made without departing from the inventive concept, it is not intended to limit the invention otherwise than as required by the appended claims.

What is claimed is:

1. An erratic movement toy comprising:

(a) a hollow housing, said housing including:

(i) two major triangular planar surfaces which are spaced apart from and generally parallel to each other;

(ii) convexly curved side walls interconnecting corresponding edges of said triangular planar surfaces;

(iii) said housing having open corner portions between adjacent ones of said side walls; and (b) a spherical body confined within the interior of said housing and freely movable therein, said spherical body providing means for causing said housing to tumble from one of said triangular planar surfaces to the other when said housing is disposed on an inclined supporting surface, and said open corner portions of said housing being sized to allow said spherical body to protrude through said open corner portions to provide a relatively smooth curved surface extending between corresponding corners of said triangular planar surfaces.

2. An erratic movement toy comprising:

(a) a hollow housing comprising:

(i) two parallel generally planar surfaces of triangular configuration;

(ii) convexly curved side walls interconnecting each side of each of said triangular planar surfaces with a corresponding side of the other of said triangular planar surfaces to provide convexly curved pivot surfaces extending between every side of each triangular planar surface and a corresponding side of the other triangular planar surface; and (b) a spherical body confined within the interior of said housing and freely movable therein, said spherical body providing means for causing said housing, when disposed on an inclined supporting surface, to tumble from one of said triangular planar surfaces to the other in an erratic manner through whichever of said convexly curved pivot surfaces said spherical body impacts.

3. An erratic movement toy comprising:

(a) a hollow housing comprising:

(i) at least two major generally planar surfaces of polygonal configuration;

(ii) convexly curved side walls interconnecting each side of each one of said polygonal planar surfaces with a corresponding side of another of said polygonal planar surfaces to provide convexly curved pivot surfaces extending between every side of each polygonal planar surface and a corresponding side of another polygonal planar surface;

(b) a spherical body confined within the interior of said housing and freely movable therein, said spherical body providing means for causing said housing, when disposed on an inclined supporting surface, to tumble from one of said polygonal planar surfaces to another in an erratic manner through whichever of said convexly curved pivot surfaces said spherical body impacts; and (c) means providing open corners between adjacent ones of said curved side walls, said open corners being sized to permit said spherical body to protrude therethrough sufficiently to provide a relatively smooth curved pivotal surface between corresponding corners of said polygonal planar surfaces.

* * * * *